United States Patent [19]

Grimes

[11] 4,195,818

[45] Apr. 1, 1980

[54] JACKING DEVICE

[76] Inventor: Gary C. Grimes, 17 Wapiti Dr., Devon, Alberta, Canada

[21] Appl. No.: 6,808

[22] Filed: Jan. 25, 1979

[30] Foreign Application Priority Data

Jan. 27, 1978 [CA] Canada ..... 295849

[51] Int. Cl.[2] ..... B66F 7/22

[52] U.S. Cl. ..... 254/94

[58] Field of Search ..... 254/94

[56] References Cited

U.S. PATENT DOCUMENTS

| | | | |
|---|---|---|---|
| 2,565,805 | 8/1951 | Farkas | 254/94 |
| 3,220,699 | 11/1965 | Falk | 254/94 |

*Primary Examiner*—Robert C. Watson

[57] ABSTRACT

The invention comprises a jacking device including a base member adapted in part to be placed in contact with a supporting surface; a ramp member connected at one of its ends to the base member, the ramp member being provided at its upper surface with guide means, preferably in the form of a slot, integral with the upper surface and extending longitudinally thereof. At least one intermediate supporting member is provided to extend between the ramp member and the base member, supporting the ramp member at an acute angle relative to the base member. Positioned for constrained sliding engagement within the slot or guide means is a load contacting member, the movement of which longitudinally of the device, is limited by the slot parameters. Finally, the device is completed by a transverse member attached to the under-surface of the base member at a point approximately one-third of the length of the base member from its attachment point with the ramp member. This additional member is substantially V-shaped, the apex being the ground engaging portion. The purpose of this member being to provide a fulcrum about which the device, when in use, may pivot.

8 Claims, 2 Drawing Figures

JACKING DEVICE

BACKGROUND OF THE INVENTION

This invention relates to jacking devices and more particularly to a device by which a vehicle axle may be raised, and supported in the raised position to facilitate the changing of a vehicle wheel.

The field of use of the present invention is not however to be restricted to vehicle applications, since the device can be utilized to raise any solid object that can be moved in a manner so as to be engaged by the device.

The art is replete with jacking devices of numerous forms, all of which have been designed for use with automotive vehicles. The most common form being the convertable screw-type jack which is vertically adjustable. Such a jack is however relatively complex in its construction, time consuming to set-up and actuate, and in addition cannot be utilized where ground clearance is minimal, or, left safely in a load carrying position for long periods of time.

The jacking device according to the present invention however contains very few moving parts, is simple in construction, therefore can be manufactured at low cost, and more importantly is capable of lifting heavy weights from a position of minimal ground clearance and is stable enough to be left unattended in the load-supporting position.

BRIEF SUMMARY OF THE INVENTION

Accordingly, the invention comprises a jacking device including a base member adapted in part to be placed in contact with a supporting surface; a ramp member connected at one of its ends to the base member, the ramp member being provided at its upper surface with guide means, preferably in the form of a slot, integral with the upper surface and extending, longitudinally thereof. At least an intermediate supporting member is provided to extend between the ramp member and the base member, therefore supporting the ramp member at an acute angle relative to the base member. Positioned for constrained sliding engagement within the slot or guide means is a load contacting member, the movement of which, longitudinally of the device, is limited by the slot parameters. Finally, the device is completed by a transverse member attached to the under-surface of the base member at a point approximately one-third of the length of the base member from its attachment point with the ramp member. This additional member is substantially V-shaped, the apex being the ground engaging portion. The purpose of this member being to provide a fulcrum about which the device, when in use, may pivot.

In a further embodiment as will be briefly described hereafter, it is invisaged that the device according to the invention may be made in a collapsible or foldable form for ease of storage. To facilitate this, the ramp member and base member are pivotally attached, and the intermediate supporting member also adapted to be pivotably attached at one end to either the base member or the ramp member, and releasably attached at the other end to the other of those members.

For a better understanding of the present invention, a preferred embodiment will now be described, reference being made to the accompanying drawings in which:

FIG. 1 illustrates in perspective, the device according to the invention supporting an axle of a vehicle, the vehicle parts being shown in phantom.

FIG. 1(*a*) illustrates, in side elevation, the slidable load supporting member of FIG. 1.

DESCRIPTION OF THE PREFERRED EMBODIMENT(S)

Figure 1:
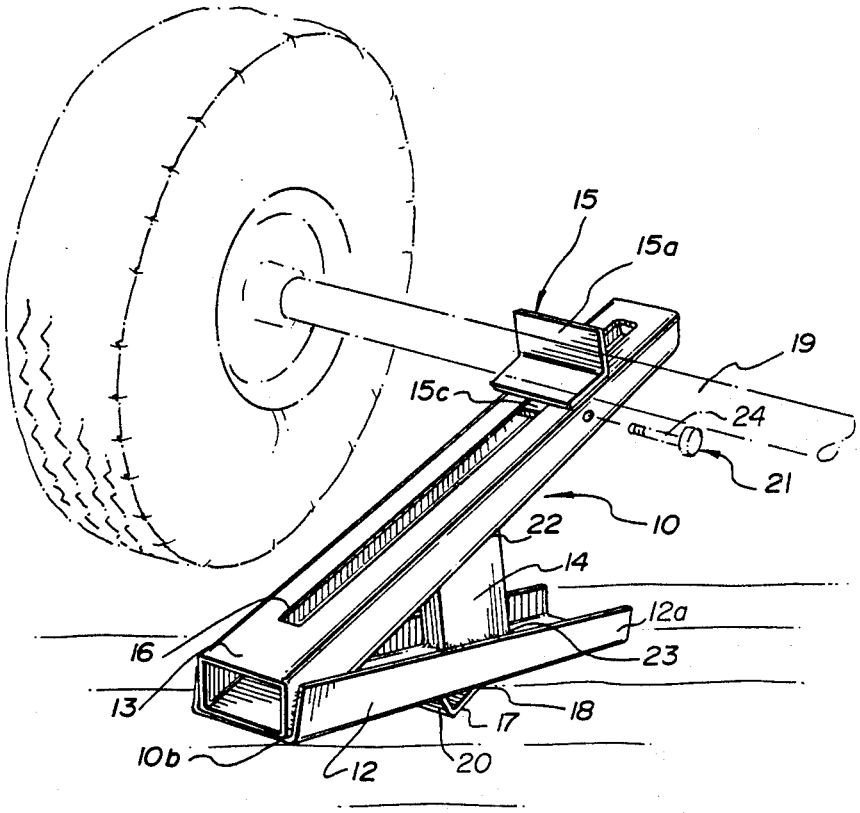

FIG. 1 shows the jacking device 10 provided by the present invention supporting the axle of a vehicle such as a trailer or mobile home. The device 10 comprises a base member 12 and inclined ramp member 13 connected at one end as by welding to base member 13. In this embodiment, member 12 consists of an elongate steel closed channel and member 12 preferably consists of a substantially U-shaped steel channel. A single intermediate support member 14 is further utilized, extending between members 12 and 13 and again attached by welding. Since the device can be manufactured in a range of sizes to accomodate larger loads, a number of such supports may be required, spaced along the base 12 accordingly.

Jacking device 10 also includes a member 15 which is slidably mounted on the ramp 13 for movement within a longitudinal slot 15, centrally disposed in the top surface thereof. The slot 16 extends from a point adjacent the lower end of member 13 to a point adjacent the upper end of that member.

Figure 1A:
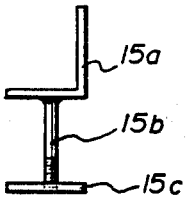

Member 15 in the form shown in insert FIG. 1*a*, consists in a right-angled top portion 15(*a*), intermediate portion 15(*b*), and in lower plate 15(*c*), the latter for convenience being threadably attached to portion 15(*c*) for ease of removal. Block 15(*c*), as will be appreciated, must be dimensioned such that in use, member 15 cannot become disengaged with the slot 16 in which it slides.

To complete the structural description of jacking device 10, attention is directed to the underside of base member 12 where there is provided a member 17 which extends transversely of member 12 and constitutes a fulcrum about which device 10 can pivot and also by reason of its configuration, a ground lock, which serves to prevent slippage of the device on the ground or road surface when being used. Member 17 in this embodiment is positioned approximately one-third of the length of base member 13, from the point of interconnection between ramp member 13 and base member 12. It will be understood that when the device is specifically utilized to raise vehicle axles, the axle height will be the determining factor vis-a-vis the positioning of member 17 with respect of member 12 and essentially comprises a single plate bent back on itself in the form of an isoseles triangle, having sides of equal length.

These sides are welded as at 18 to the underside of base member 12.

The jacking device of the present invention is used in the following manner.

Firstly, the device 10 is inserted under the vehicle, and portion 15(*a*) of member 15 is positioned so that it is at the lowermost end of slot 16, or at such a position where it can be engaged with the axle indicated at 19. In the example shown, it is intended that the wheel of the trailer be changed. Movement of the trailer is effected by the towing vehicle, which results in the member 15 moving up ramp member 13, the jacking device being prevented from sliding by virtue of the sharp edge 20 of member 17 contacting the surface of the ground. Continual forward movement of the towed trailer will cause member 15 to slide to the upper limit of slot 16 at which time the load will have been transferred to the upper portion of device 10, thus the device will have rotated about the fulcrum provided by member 17, the end 12(*a*), initially in air will now be in contact with the ground. While in practice, it has been found unnecessary to lock the member 15 in its upper supporting position, as an additional safety function, a simple locking arrangement 21 (shown in phantom) may be provided.

With such a lock 21, the towing vehicle may be reversed until pin 24 is engaged by the now descending member 15 and the trailer will be securely held in the elevated position, and the trailer may be detached from the towing vehicle if required. As will be appreciated, the wheel may now be removed in the normal manner, the jacking device providing a stable support as will be obvious from the above description, to facilitate lowering of the trailer once the wheel changing operation is complete, it is simply necessary to reverse the steps outlined heretofore.

As can be seen from the drawings and understood from the above description, the jacking device of this embodiment is a rigid structure, preferably formed from steel or cast iron to provide the necessary strength, however, without departing from the principal of the inventive structure, it is invisaged that the device could be constructed so as to enable it to be folded for ease of storage. To effect this modification, it would be necessary to provide, for example, but not shown, that member 12 and 13 be joined at the lower point of attachment 10(*b*) by means of a hinge, and that support member 14 be releasably attached at its upper end 22 to ramp member 13, while being pivotably attached at end 23 to base member 12.

Such a construction would permit the ramp member 13 to be folded into a position adjacent and substantially parallel to base member 12, thus providing a compact package which may be conveniently stored while not required.

As previously mentioned, the device according to the invention may be enlarged to facilitate its use in lifting heavier loads. As will be appreciated, increased loading on member 15 will increase the friction between that member and ramp member 13 with the result that member 15 would no longer be freely slidable. To overcome this problem and thus reduce friction which it is emphasized would only occur under high load conditions, it is invisaged that member 15(*a*) would be mounted on, for example, a roller assembly, the rollers contacting the upper surface of ramp member 13.

Further modifications and alternative embodiments of the invention will be apparent to those skilled in the art in view of the foregoing description. Accordingly, this description is to be construed as illustrative only and is for the purpose of teaching those skilled in the art the manner of carrying out the invention. It is further understood that the form of the invention herewith shown and described is to be taken as the presently preferred embodiment. Various changes may be made in the shape, size and general arrangement of components. For example, equivalent elements may be substituted for those illustrated and described herein, parts may be used independently of the use of other features, all as will be apparent to one skilled in the art after having the benefits of the description of the invention.

What is claimed is:

1. A jacking device comprising a base member adapted in part to be placed in contact with a supporting surface; a ramp member connected at one of its ends to said base member, said ramp member being provided, at its upper surface with guide means integral with said upper surface and extending longitudinally thereof; at least one intermediate supporting member extending between said base member and said ramp member thereby providing a support for said ramp at an acute angle relative to said base member; a load supporting member adapted for constrained sliding engagement with said guide means; and surface engaging means attached to an under surface of said base member so as to provide a fulcrum about which said device can pivot.

2. The device according to claim 1 wherein said ramp member is of closed channel configuration and said base member is substantially U-shaped in cross-section, the said walls of said base member extending towards the said ramp member.

3. The device according to claim 2 wherein said guide means comprises a guide slot in the upper surface of said ramp member extending longitudinally thereof and terminating short of each end of said ramp member.

4. The device according to claim 3 wherein said ramp member is fixedly attached to said base member.

5. The device according to claim 3 wherein said ramp member is pivotably attached to said base member; said intermediate supporting member is at one end pivotably attached to said base member and at the other end adapted for releasable attachment to said ramp member.

6. The device according to claim 3 wherein said load supporting member is a three component structure comprising an upper right-angled load engaging component, an intermediate component attached thereto, and extending downwardly through said guide slot, and a lower blocking component releasably attached to said intermediate component below said guide slot, whereby said load supporting member is constrained for sliding movement within the limits defined by said guide slot.

7. The device according to claim 1 wherein said surface engaging means comprises a substantially V-shaped member extending transversely of said base member, the apex of said surface engaging means providing the fulcrum about which said device may pivot.

8. The device according to claim 7 wherein said surface engaging means is positioned at a distance from the interconnection between said base member and said ramp member, equal to at least one-third of the total length of said base member.

* * * * *